US008839732B2

(12) United States Patent
Brelsford

(10) Patent No.: US 8,839,732 B2
(45) Date of Patent: Sep. 23, 2014

(54) MOORING DEVICE

(71) Applicant: Loren Brelsford, Lewis Center, OH (US)

(72) Inventor: Loren Brelsford, Lewis Center, OH (US)

( * ) Notice: Subject to any disclaimer, the term of this patent is extended or adjusted under 35 U.S.C. 154(b) by 0 days.

(21) Appl. No.: 13/656,838

(22) Filed: Oct. 22, 2012

(65) Prior Publication Data

US 2013/0061792 A1 Mar. 14, 2013

Related U.S. Application Data

(62) Division of application No. 13/071,429, filed on Mar. 24, 2011, now Pat. No. 8,291,847, which is a division of application No. 12/183,875, filed on Jul. 31, 2008, now Pat. No. 7,921,791.

(60) Provisional application No. 60/953,049, filed on Jul. 31, 2007.

(51) Int. Cl.

| | |
|---|---|
| ***B63B 59/02*** | (2006.01) |
| ***B63B 21/00*** | (2006.01) |
| ***B63B 21/20*** | (2006.01) |
| ***E02B 3/26*** | (2006.01) |

(52) U.S. Cl.

USPC ..... 114/219; 405/212

(58) Field of Classification Search

USPC ..... 114/219, 220; 405/212–216, 21–23, 405/25–28; D12/167–172; 248/60; 294/74–77, 82.14, 152; 293/102, 118, 293/119, 122–128

See application file for complete search history.

(56) References Cited

U.S. PATENT DOCUMENTS

| | | | | | |
|---|---|---|---|---|---|
| 675,318 | A * | 5/1901 | Boothe | ..... | 24/17 A |
| 929,952 | A * | 8/1909 | Johnson | ..... | 24/17 R |
| 1,093,096 | A * | 4/1914 | Allen | ..... | 24/17 A |
| 1,617,556 | A * | 2/1927 | Vineberg | ..... | 24/17 R |
| 2,413,210 | A * | 12/1946 | Blackman | ..... | 114/219 |
| 2,424,635 | A * | 7/1947 | Schwall, Jr. | ..... | 405/215 |

(Continued)

FOREIGN PATENT DOCUMENTS

| | | | | |
|---|---|---|---|---|
| DE | 3504142 A1 * | 8/1986 | ..... | A45C 5/04 |
| FR | 2650805 | 2/1991 | | |

(Continued)

OTHER PUBLICATIONS

Tideminders: Resources; www.tideminders.com/resources.htm; (Aug. 29, 2008).

(Continued)

*Primary Examiner* — Ajay Vasudeva

(74) *Attorney, Agent, or Firm* — Hahn, Loeser & Parks LLP; Rex W. Miller, II

(57) ABSTRACT

A portable water level-responsive mooring device has a mooring strap with a ring capable of engaging the mooring device around a dock piling. The mooring strap has a suitable length of cord having a clip or ring on each end capable of releasably attaching to a fender, spacing tubes, and rollers. The spacing tubes and rollers have an outer diameter greater than the outer diameter of the spacing tubes and an inner diameter larger than the outer diameter of the cord. The cord is positioned within an arrangement of the spacing tubes and rollers, the length of cord being sufficient to wrap around a dock piling.

5 Claims, 5 Drawing Sheets

(56) References Cited

U.S. PATENT DOCUMENTS

| | | | | | |
|---|---|---|---|---|---|
| 2,497,030 | A | * | 2/1950 | Lewis | 439/793 |
| 2,808,016 | A | | 10/1957 | Jarnot | |
| 2,938,492 | A | | 5/1960 | Kulick | |
| 2,965,064 | A | | 12/1960 | Wallace | |
| 3,081,731 | A | | 3/1963 | McEvoy | |
| 3,120,831 | A | | 2/1964 | Fulton | |
| 3,122,120 | A | | 2/1964 | Jorgenson | |
| 3,224,404 | A | | 12/1965 | Jong | |
| 3,389,675 | A | | 6/1968 | Kieft et al. | |
| 3,401,413 | A | | 9/1968 | Anselmi | |
| 3,442,245 | A | | 5/1969 | Christians et al. | |
| RE27,050 | E | | 2/1971 | Jorgenson | |
| 3,695,209 | A | | 10/1972 | Giese | |
| 3,757,370 | A | | 9/1973 | Seno et al. | |
| 3,951,384 | A | * | 4/1976 | Hildreth, Jr. | 256/1 |
| 3,993,013 | A | | 11/1976 | Nunziato et al. | |
| 4,022,450 | A | | 5/1977 | Smith, Jr. | |
| 4,376,419 | A | | 3/1983 | Heilskov | |
| 4,480,576 | A | | 11/1984 | Mills | |
| 4,627,375 | A | | 12/1986 | Davis et al. | |
| 4,912,816 | A | | 4/1990 | Brandt | |
| 5,050,521 | A | | 9/1991 | Stone | |
| 5,265,553 | A | | 11/1993 | Brydges | |
| 5,361,716 | A | | 11/1994 | Cotton | |
| 5,441,006 | A | | 8/1995 | Wood | |
| 5,467,727 | A | | 11/1995 | Godvin et al. | |
| 5,603,280 | A | | 2/1997 | Shackelford, Jr. | |
| 5,634,421 | A | | 6/1997 | Velarde | |
| 5,762,016 | A | | 6/1998 | Parsons | |
| 5,937,781 | A | | 8/1999 | Isella et al. | |
| 6,062,158 | A | | 5/2000 | Blanchard | |
| 6,216,625 | B1 | | 4/2001 | Baluha | |
| 6,390,009 | B2 | | 5/2002 | Brown et al. | |
| 6,532,885 | B1 | | 3/2003 | Cordoba | |
| D473,508 | S | | 4/2003 | Mastrofilipo, Jr. | |
| 6,994,047 | B1 | | 2/2006 | Pent, III | |
| 7,021,230 | B1 | | 4/2006 | Lawrence | |
| 7,188,579 | B2 | | 3/2007 | Lenonides | |
| D593,924 | S | | 6/2009 | Newmark | |
| 7,921,791 | B2 | * | 4/2011 | Brelsford | 114/219 |
| 8,291,847 | B2 | * | 10/2012 | Brelsford | 114/219 |
| 2006/0060124 | A1 | | 3/2006 | DiCampli | |

FOREIGN PATENT DOCUMENTS

| | | | | |
|---|---|---|---|---|
| FR | 2683788 | | | 5/1993 |
| GB | 1409243 | A | * | 10/1975 |
| SU | 712320 | A | * | 1/1980 |
| SU | 1454776 | A | * | 1/1989 |

OTHER PUBLICATIONS

Tideminders Instructions (2 pages) (enclosed with product purchased Aug. 2008).

* cited by examiner

MOORING DEVICE

This application is a divisional application of U.S. patent application Ser. No. 13/071,429, filed. Mar. 24, 2011, now U.S. Pat. No. 8,291,847, which is a divisional of U.S. patent application Ser. No. 12/183,875, filed Jul. 31, 2008, now U.S. Pat. No. 7,921,791, which claims priority to and the benefit of U.S. Provisional Patent Application 60/953,049, filed. Jul. 31, 2007, each of which are incorporated herein by reference.

BACKGROUND AND SUMMARY OF THE INVENTION

The present disclosure relates to portable docking systems, and more particularly to portable docking systems that accommodate the rise and fall of water levels.

Captains of boats and other vessels that navigate waterways should take the rise and fall of the water levels into account. For example, along some shore lines, the water level varies greatly between high tide and low tide. The geographic shape of the shoreline may contribute to how much the water level varies. In some locations, the difference between the water level at high tide and the water level at low tide can be as much as 16 meters. In other areas, the difference between the water level at high tide and the water level at low tide can be as little as a few centimeters. More generally, the water level may vary between about 1 to 2 meters between high and low tide.

The captain of a boat considers the current water level and possible future water levels when docking a vessel. If the captain secures the boat tightly to a dock at high tide, in as little as two hours the boat could be hanging from the dock with little water beneath it, causing damage to the boat and to the dock. For this reason, many boaters have to continuously readjust their mooring to keep their boat level as the water level changes. This causes great inconvenience for the captain of the vessel, who may have to return to the boat every 20 or 30 minutes.

Further, the water along the docks may be choppy as surface waves reach the shore. The wake from other boats cause further waves that cause a docked boat to bob alongside the dock. Some waves are large enough to propel a boat against a dock or another boat with great force, causing damage to the dock and boat. Thus, the captain must secure the boat tightly against the dock to hold the boat in place against wave forces.

In addition to securing a boat to the dock piling, the boat may need to be cushioned against wave forces. Generally, wave forces may cause the boat to come into contact with the dock pilings. In order to prevent damage to a boat, there is a need for a structure such as a fender to cushion the impact of between the boat and dock piling.

The need to secure the boat against wave forces can be contrary to the need to allow the boat to freely rise and fall with the water level during high and low tide. For inexperienced boaters, it may be particularly difficult to balance these opposing requirements. If a mooring line is left loose enough to allow the boat to drop 2 meters with the tide, the 2 meters of slack will allow the waves to cast the boat against the dock, creating the potential for damage. If the mooring secures the boat to the dock, the boat may be unable to move when the tide changes, creating the potential for damage.

Successfully securing a boat to a dock may be time consuming and inconvenient, depending on the experience of the captain of the boat. Although spring lines may be employed as a means for mooring boats, such devices involve complicated arrangements of lines and may be difficult for amateur or inexperienced boaters to use. Furthermore, the time required to set spring lines correctly, even for an experienced boater, may be inconvenient. Even after spring lines are initially configured, the captain of the boat may still need to adjust the lines to accommodate the rising and falling of the water level or to prevent interference with existing dock lines.

Various docking systems are known in the art that attempt to solve these problems. Docking systems are available for permanent installation at a dock providing a mechanism that moves vertically with the water level, but is securely attached to the dock. But this is not a satisfactory solution for the captain of a vessel who wishes to temporarily dock during an outing, such as docking along-side a work-site, a cargo dock, a restaurant, a recreation area, or any other temporary and short term docking situation. There remains a need in the art for a mooring device that securely moors a vessel to a dock yet accommodates the changing water level of the body of water.

The portable water level-responsive mooring device comprises a mooring strap comprising a length of cord, the length of cord being sufficient to wrap around a dock piling; a ring removeably affixed to one end of the mooring strap; a clip removably affixed to an opposite end of the mooring strap, the clip capable of releasably attaching to the ring; a plurality of spacing tubes; and a plurality of rollers having an outer diameter greater than the outer diameter of the spacing tubes and an aperture axially positioned there through, the cord positioned within an arrangement of the spacing tubes and rollers.

The portable water level responsive mooring device also comprises a method of securing a vessel to a dock piling and responding to a water level that comprises providing a portable water level-responsive dock securing system comprising a mooring strap comprising a length of cord having a ring on one end capable of releasably attaching to a clip on an opposite end, a plurality of spacing tubes and a plurality of rollers having an outer diameter greater than the outer diameter of the spacing tubes and an inner diameter larger than the outer diameter of the cord, the cord positioned within an arrangement of the spacing tubes and the rollers, the length of cord being sufficient to wrap around a dock piling; wrapping the mooring strap around the dock piling; attaching each mooring strap clip to the ring such that the vessel is adjacent the dock piling; and translating the mooring strap along the dock piling by the rollers as a water level changes.

The portable water level-responsive mooring device also comprises a cleat strap comprising a cord having a loop capable of engaging a boat cleat and a ring opposite the loop; a mooring strap comprising a length of cord having a clip on each end capable of releasably attaching to the ring, a plurality of spacing tubes, and a plurality of rollers having an outer diameter greater than the outer diameter of the spacing tubes and an inner diameter larger than the outer diameter of the cord, the cord positioned within an arrangement of the spacing tubes and the rollers, the length of cord being sufficient to wrap around a dock piling; and a fender having a clip capable of releasably attaching to the ring. The dock securing system further comprises an extension strap comprising a cord having an extension strap clip on one end and an extension ring on another end, the extension clip capable of releasably attaching to the extension ring to form a loop capable of receiving one or more mooring strap clips, the extension strap clip capable of releasably attaching to a cleat strap ring.

DETAILED DESCRIPTION OF THE DRAWINGS

Figure 1:
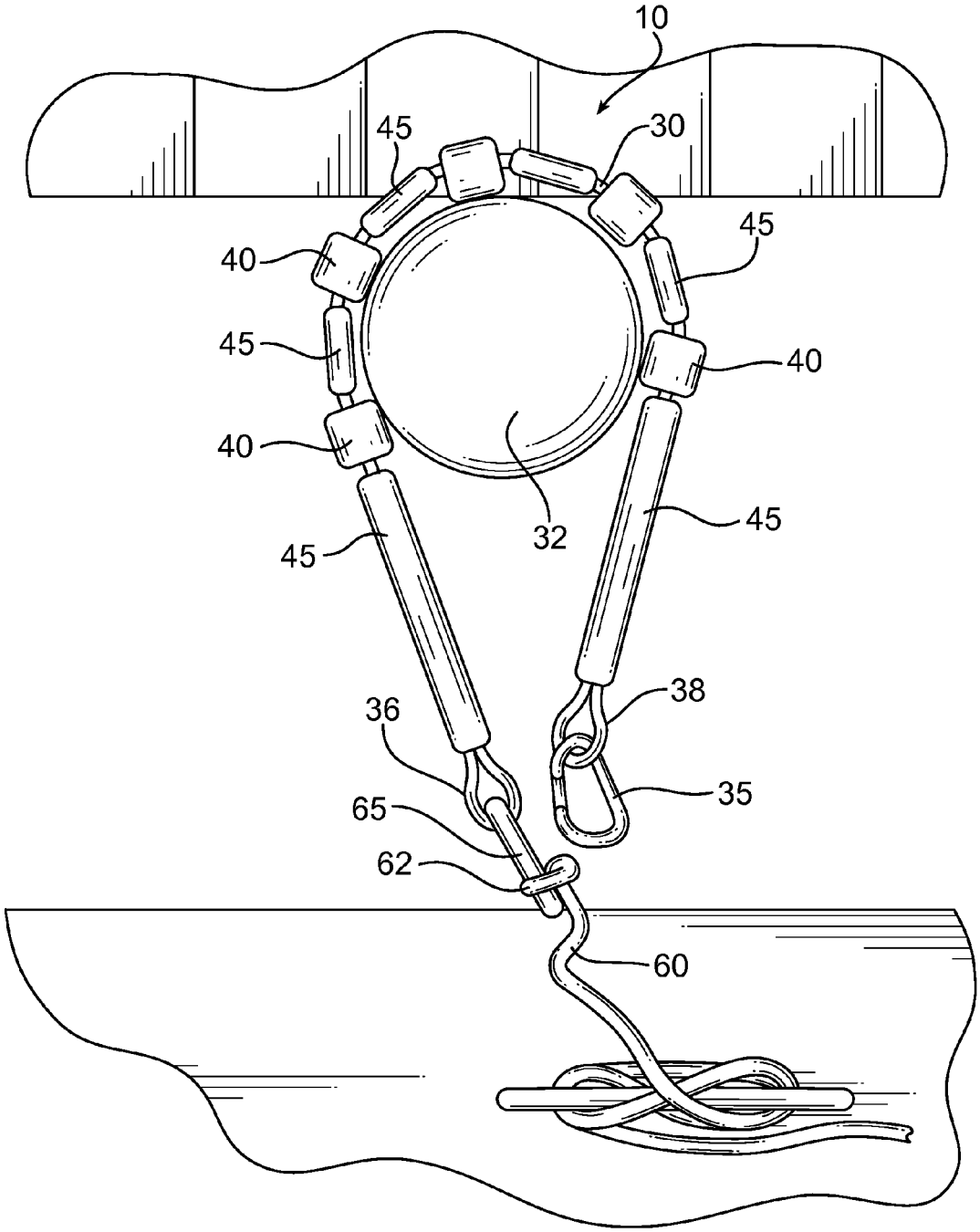
FIG. 1 is a plan view of a mooring device in position around a dock piling before securing a clip.
Figure 2:
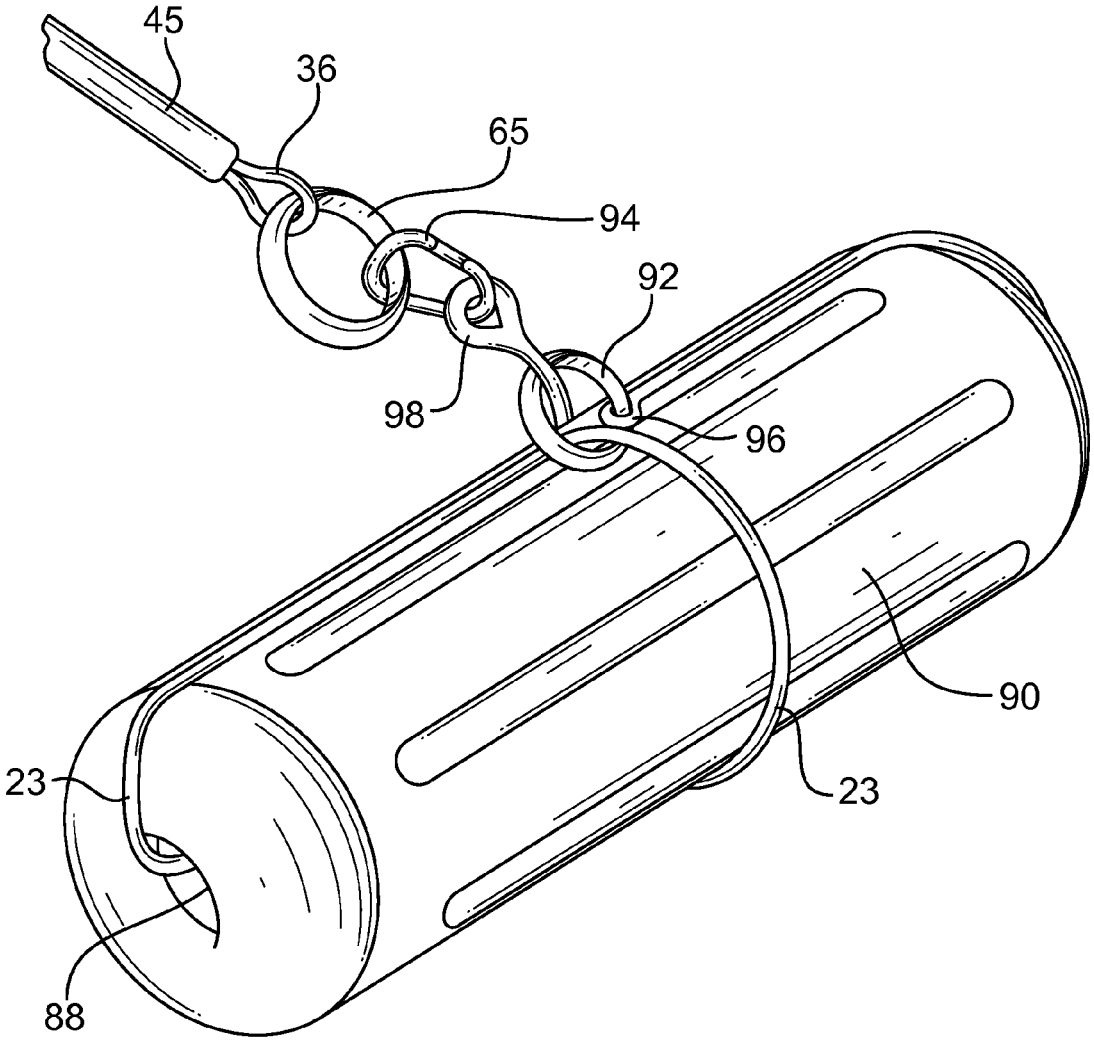
FIG. 2 is a perspective view of the boat fender and fender cord.

Referring now to FIGS. 1 and 2, a portable water level-responsive mooring device or dock securing system has a mooring strap 10 capable of forming a loop around a dock piling 32. The mooring strap 10 may include a ring 65 on one end and a clip 35 on the opposite end of the mooring strap 10. The mooring strap 10 may further include an arrangement of rollers 40 and spacing tubes 45. In the embodiment shown in FIG. 1, the clip 35 releasably attaches to the ring 65 to form a loop around the dock piling 32. The ring 65 may also connect features of the dock securing system, such as rope, an extension strap, a cleat strap, additional clips 35, and a fender 90.

The mooring strap 10 may include a cord 30 having a length sufficient to wrap around a dock piling 32. The ring 65 may be connected to the cord 30 by forming a loop 36 through the ring 65, and the clip 35 may be removably affixed to the opposite end of the cord 30 by forming a loop 38 through the clip 35. The loops 36, 38 may be formed by a rope splice or eye splice in the cord 30. Alternately or in addition, the loops 36, 38 may be formed in the cord using a crimp ring, crimp band, clamp, or other fastener (not shown). Alternately or in addition, loops 36, 38 may comprise a knot. The mooring strap 10 may further include at least two rollers 40, and at least three spacing tubes 45. Alternately, the mooring strap 10 may have at least four rollers 40 and at least five spacing tubes 45 in an arrangement of alternating spacing tubes 45 and rollers 40.

As shown in FIG. 1, the cord 30 may be positioned within various arrangements of the spacing tubes 45 and rollers 40. As shown in the example in FIG. 1, the mooring strap 10 may have an alternating arrangement of rollers 40 and various lengths of spacing tubes 45 as desired. In one alternate, the arrangement of spacing tubes 45 and rollers 40 may comprise a spacing tube 45 followed by two rollers 40, followed by a spacing tube 45. This pattern may be repeated until the mooring strap 10 has a desired number of spacing tubes 45 and rollers 40. In another arrangement, the spacing tubes 45 and rollers 40 may have a spacing tube 45, a plurality of rollers 40, and an additional spacing tube 45. The mooring strap 10 may have any suitable arrangement of rollers 40 and spacing tubes 45. As shown in FIG. 1, the arrangement of spacing tubes 45 and rollers 40 may be such that the lengths of the spacing tubes 45 near the ends of the mooring strap 10 are longer than the spacing tubes between rollers 40. Alternately, the length of the spacing tubes 45 may be any length to correspond with a desired arrangement of spacing tubes 45 and rollers 40. The length of the spacing tubes 45 may vary according to the length of the mooring strap 10 and the number of rollers 40 desired.

Figure 7:
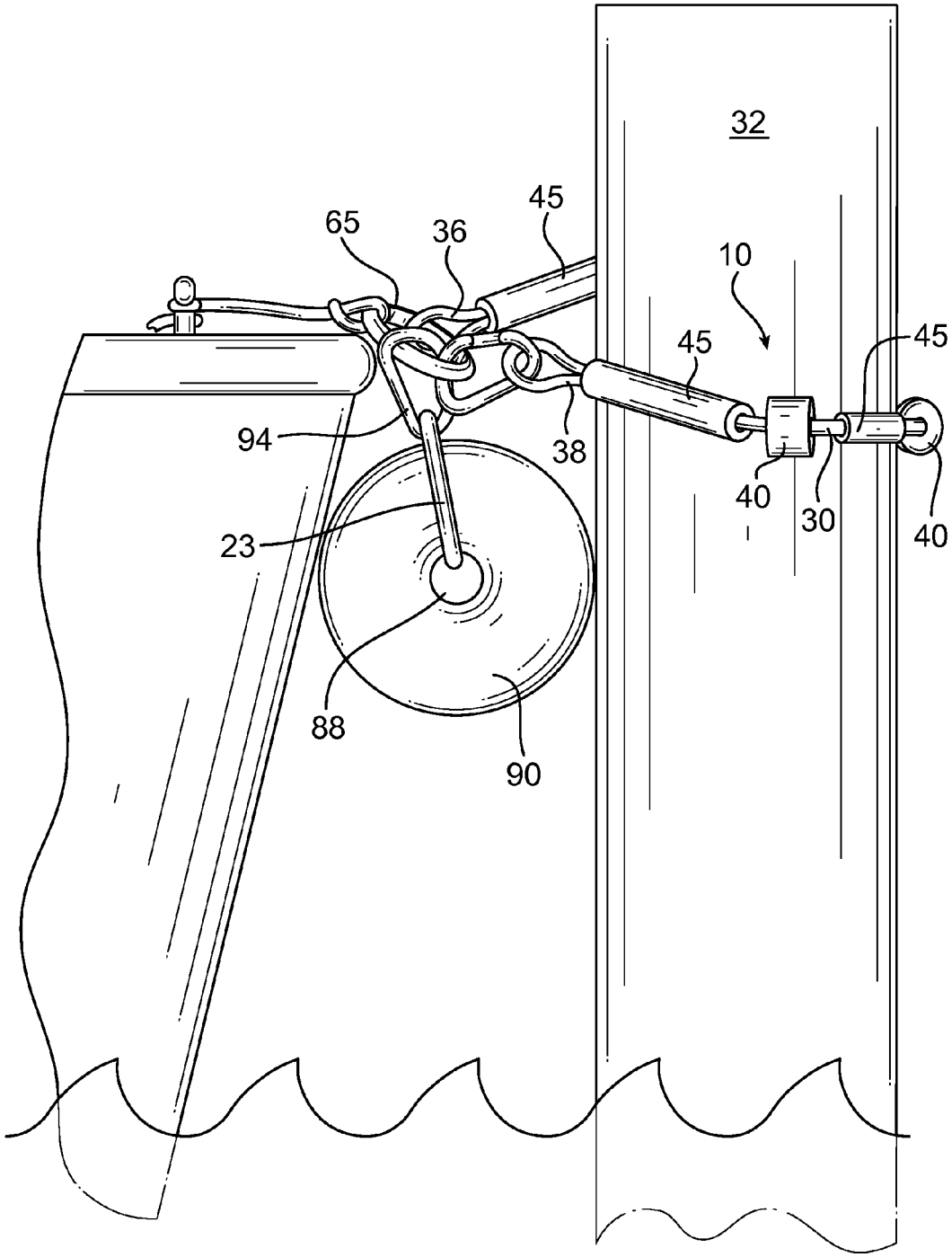
FIG. 7 is a side elevational view of the mooring device mooring a vessel to a dock piling.

The mooring device may include a fender capable of protecting the boat from contacting the dock or dock piling. The fender may be cylindrical, spherical, spheroidal, or other suitable shape for a fender. As shown in FIGS. 2 and 7, a fender 90 may be provided having an axially extending aperture 88 there through. A fender cord 23 may be used to secure the fender 90 to the ring 65 of the mooring strap 10. The fender cord 23 may be constructed from a length of cord of any suitable material such as rope. The fender cord 23 may include a fender ring 92 on one end and a clip 94 removably attached to the opposite end of the fender cord 23. The fender ring 92 may be affixed to the fender cord 23 by forming a loop 96 through the fender ring 92, and the clip 94 may be removably affixed to the opposite end of the cord 23 by forming a loop 98 through the clip 94. The loops 96, 98 may be formed by a rope splice or eye splice in the cord 23. Alternately or in addition, the loops 96 and 98 may be formed in the cord using a crimp ring, crimp band, clamp, or other fastener (not shown). Alternately or in addition, loops 96, 98 may comprise a knot. In an alternate embodiment, not shown, the fender ring 92 is integrally connected to the fender cord 23, such as formed as a loop, to receive the fender clip 94 in the installed position. In this embodiment, the fender ring 92 may be a small loop or an eye splice, and may be reinforced by an eye thimble, sleeve, or other reinforcement (not shown).

The fender cord 23 may be secured to the fender 90 by extending through the fender in a first loop and around the fender in a second loop transverse to the first loop. As shown in FIG. 2, the fender cord 23 may be secured to the fender 90 by a method comprising the steps of wrapping the cord 23 axially around the fender through the aperture 88, passing the cord through the fender ring 92, wrapping the cord radially around the fender, then passing the cord through the fender ring 92 a second time. Stated another way, the length of cord 23 extends substantially around the fender 90 along the axis of the aperture 88, and around the fender 90 around the axis of the aperture 88 by passing through the fender ring 92. The fender clip 94 may be removed from the fender cord 23 while securing the cord 23 to the fender 90. The clip 94 may be used to releasably attach the fender 90 to the ring 65 or the clip 35 of the mooring strap 10.

Alternately, the fender cord 23 may be secured to the fender 90 such that the fender will hang with the axis of the aperture in an approximately upright orientation. In this configuration, the fender cord 23 may be secured to the fender 90 by a method comprising the steps of wrapping the cord 23 axially around the fender through the aperture 88, and passing the cord through the fender ring 92, where the fender ring 92 is positioned approximately in alignment with the aperture. Alternately, when the fender ring 94 is larger than the aperture 88 and cannot pass through the aperture 88, the fender cord 23 may be threaded through the aperture 88 such that the fender 20 is supported by the fender ring 92 when the opposite end (96) of the fender cord is clipped or tied to the mooring device or boat or other location as desired.

The cords 30, 23 may be of any suitable cord, including polymer or natural fiber ropes, metal cable or strap, "bungee" or other elastic bands, and other cordage. The mooring strap cord 30 may be a different material than the fender cord 23. In one embodiment, the cord 30 is constructed from steel cable, such as a steel cable with a protective coating, or a stainless steel cable. In an alternate embodiment, the cords 30, 23 comprise a polymer or natural fiber cordage or rope, such as, but not limited to nylon, polyester, polypropylene, hemp, or cotton. Alternately, the cords 30, 23 may include a core of an elastic and resilient material, for example but not limited to rubber or elastomer. The cords 30, 23 may be covered with a fiber braid, such as but not limited to nylon, polyester, polypropylene, hemp, or cotton.

The rollers 40 may be cylindrical, spherical, spheroidal, or any other suitable shape for a roller having an axial extending aperture there through. The outer diameter of the rollers 40 may be greater than the outer diameter of the spacing tubes 45 and the inner diameter larger than the outer diameter of the cord 30. In this way, the cord 30 may function as an axle and the rollers 40 may rotate around the cord. As shown in FIG. 1, the rollers 40 may have a larger diameter in a center portion than the diameter at one or both ends.

The rollers 40 may be a rigid or semi-rigid material to enable the rollers 40 to translate along a dock piling 32 when in use. The rollers 40 may be made of a material such as for example but not limited to polyvinyl chloride, polyethylene, polypropylene, nylon, stainless steel, or other material. Alternately or in addition, the rollers 40 may be a thermoplastic material having a density between about 0.80 and 1.0 gram per cubic centimeter to float in water. In some embodiments, the rollers 40 may be a foamed material having a density between about 0.40 and 0.90 gram per cubic centimeter.

The spacing tubes 45 may be a tube having an inside diameter greater than or equal to the outer diameter of the cord 30. The spacing tubes 45 are of desired lengths to correspond with a desired arrangement of spacing tubes 45 and rollers 40. Accordingly, the length of the spacing tubes 45 may vary according to the length of the mooring strap 10 and the number of rollers 40 desired. As shown in FIG. 1, the arrangement of spacing tubes 45 and rollers 40 may be such that the lengths of the spacing tubes 45 near the clips 35 is longer than the spacing tubes 45 between rollers 40. The spacing tubes 45 may be made from any suitable material such as for example but not limited to polyvinyl chloride, polyethylene, polypropylene, nylon, stainless steel, or other material.

The clips 35, 80, 94 may be a normally-closed, spring loaded clips. As shown in FIG. 1, the clips 35 may be a carabiner style clip. Alternately, the clip 35 may be a cord clip, snap hook, leash clip, or any style of clip capable of attaching the mooring strap 10 to the ring 65. The clip 35 may also be a lockable clip.

The ring 65 may be a circular or ring shape, but is not limited to such shape. The ring 65 may be elliptical, oval, or other suitable shape.

The clips 35, 80, 94 and the rings 65, 85 may transfer forces caused by water pulling the vessel from the dock piling 32. Accordingly, the clips 35, 80, 94 and the rings 65, 85 may be made of a material capable of securing the vessel to the dock piling 32. The clips 35, 80, 94 and the rings 65, 85 may be made from a material such as for an example, but not limited to, steel, stainless steel, cast iron, aluminum, nylon, acetal, polyester or other suitable thermoplastic or metal materials. The clips 35, 80, 94 and the rings 65, 85 may be attached to the cord 30 by a crimp, crimp ring, crimp band, clamp, or other fastener (not shown). Alternately or in addition, the clips 35, 80, 94 and the rings 65, 85 may be attached to the cord by a rope splice, eye splice, or knot.

Figure 3:
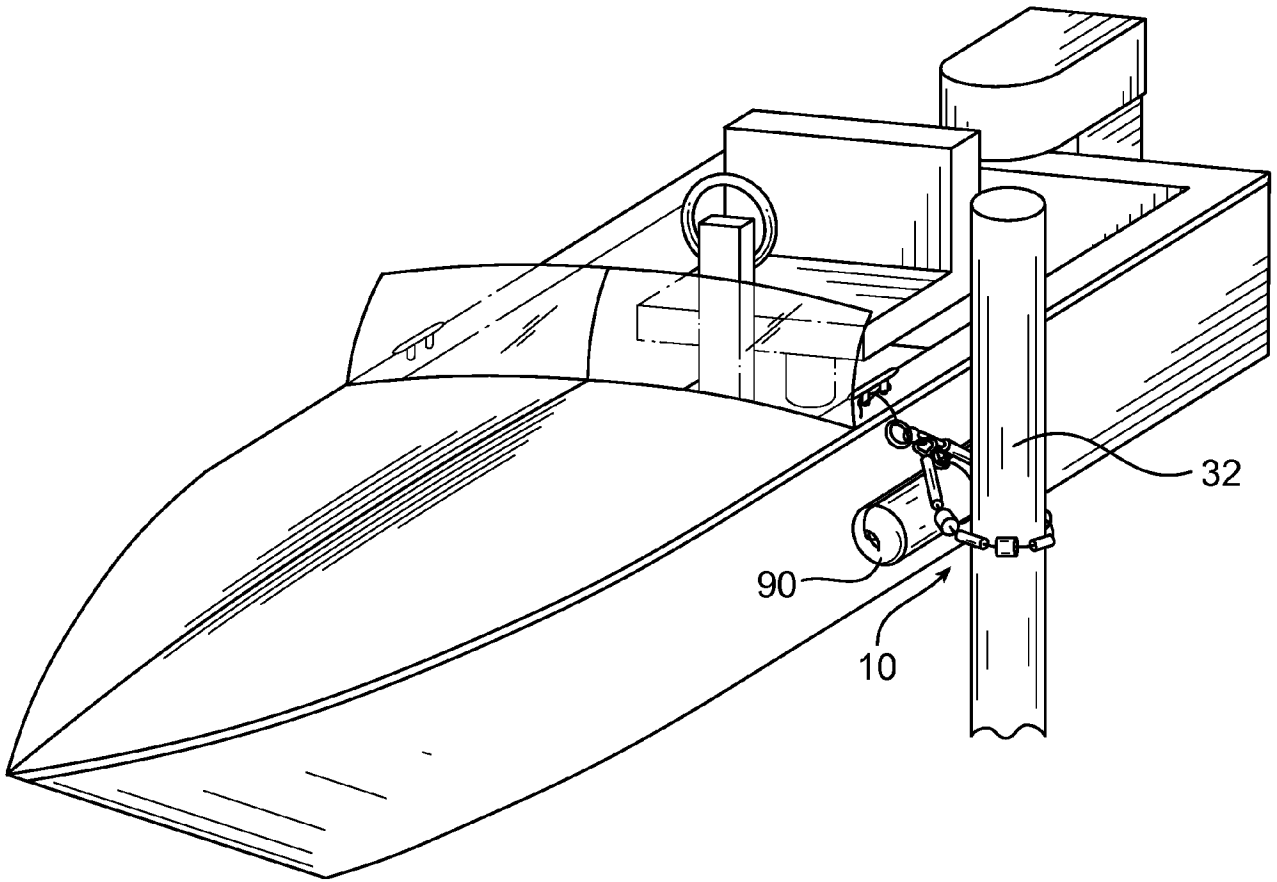
FIG. 3 is a perspective view of the mooring device mooring a vessel to a dock piling.

The method of using the dock securing system may include providing the mooring strap 10 with the ring 65 to connect the mooring strap 10 and fender 90 to the dock piling 32. In operation, the dock securing system may be utilized by the method of wrapping the mooring strap 10 around the dock piling 32 and securing the clip 35 to the loop 38 and to the ring 65. The clip 35 releasably attaches to the ring 65 to form a loop around the dock piling 32 as shown in FIG. 3. The length of the mooring strap 10 may be determined by the circumference of a dock piling 32. The rollers 40 assist the dock securing system in raising and lowering with the change in water level. As the water level changes, the vessel naturally rises and falls with the water level. The vessel pulls on the dock securing system as the vessel changes height relative to the dock, causing the mooring strap 10 to move along the dock piling 32 by the rollers 40 as the water level changes. The fender 90 may also releasably attach the ring 65 of the mooring strap 10 in order to protect the boat from coming into contact with the dock piling 32.

Figure 4:
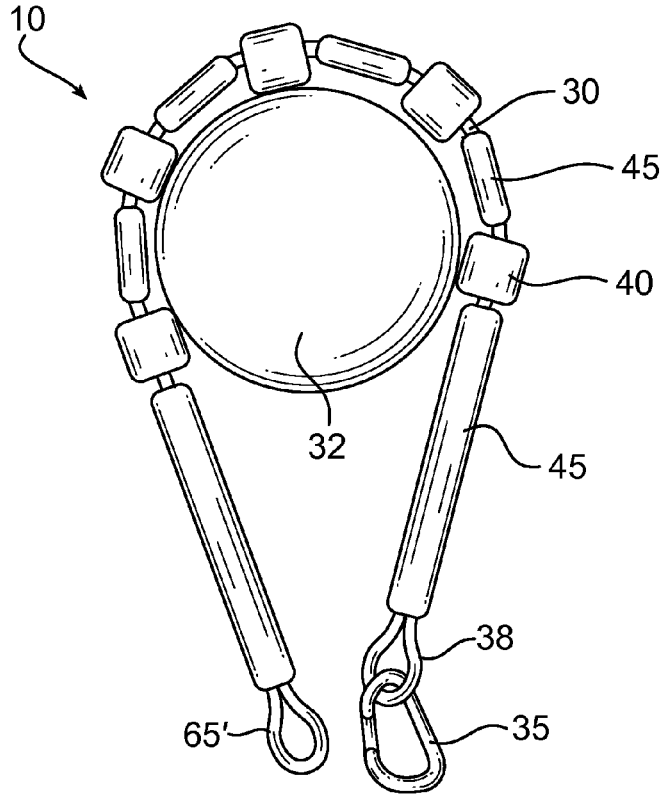
FIG. 4 is a plan view of an alternate configuration of a mooring strap of a mooring device in position around a dock piling before securing a clip.

In an alternate embodiment shown in FIG. 4, the ring 65' is integrally connected to the cord 30, such as formed as a loop, to receive the clip 35 in the installed position. The ring 65' may be a small loop or an eye splice, and may be reinforced by an eye thimble, sleeve, or other reinforcement (not shown). In yet another alternate, not shown, a clip may be used as the ring 65.

Figure 5:
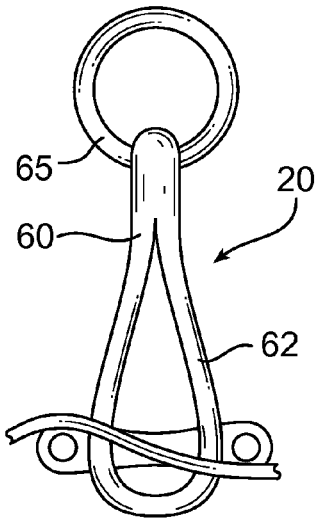
FIG. 5 is an extension strap of the present disclosure.

In some embodiments, the portable water level responsive dock securing system may have a cleat strap 20 as shown in FIG. 5, in addition to the mooring strap 10. The cleat strap 20 may include a cord 60 formed into a loop 62 capable of engaging a boat cleat on one end, and the ring 65 positioned on the cleat strap 20 opposite the loop 62. Alternately, instead of ring 65, a small loop such as an eye splice may be provided (not shown). In yet another alternate, a clip may be provided (not shown). The loop 62 may be formed in the cord by a rope splice or eye splice in the cord 60. Alternately or in addition, the loop 62 may be formed in the cord using a knot, a crimp ring, crimp band, clamp, or other fastener (not shown). The cord 60 may be a steel cable, such as a steel cable with a protective coating or a stainless steel cable. Alternately, the cord 60 may be a length of rope or cordage of nylon, cotton, and may have an elastic core.

The method of using the dock securing system may include wrapping or looping the cleat strap 20 around a boat cleat, wrapping or looping the mooring strap 10 around the dock piling 32, and attaching each mooring strap clip 35 to the cleat strap ring 65 such that the vessel is adjacent the dock piling 32.

Figure 6:
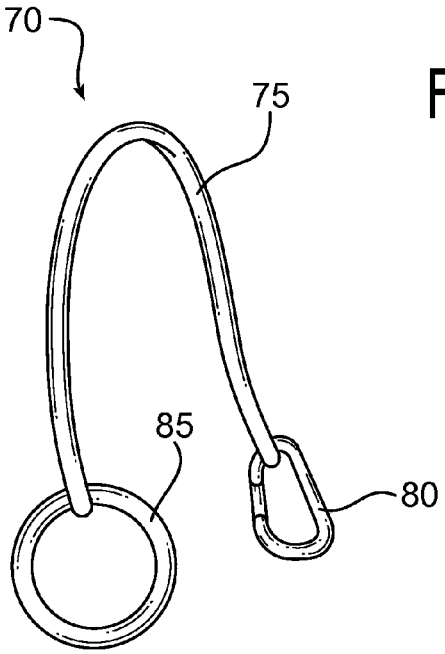
FIG. 6 is a plan view of a cleat strap of the mooring device in position around a boat cleat.

In an additional or alternative embodiment shown in FIG. 6, the portable water level-responsive dock securing system may include an extension strap 70. The extension strap 70 may have a cord 75 having an extension clip 80 on one end, the extension clip 80 capable of releasably attaching to a receiver 85 on the opposite end of the extension strap. The receiver 85 positioned on the end of the extension strap may comprise at least one selected from the group consisting of an extension ring, extension clip, and loop. The extension clip 80 may be capable of releasably attaching to the receiver 85 and/or the ring 65 of the mooring strap.

The alternative or additional method of using the dock securing system may include the steps of releasably attaching each mooring strap clip 35 to the receiver 85 instead of ring 65, and releasably attaching the extension clip 80 into the ring 65 providing an extension distance about the length of the extension strap. Alternately, the extension strap 70 may be folded in half to provide an extension distance about ½ the length of the extension strap 70. When folding the extension strap 70, the extension clip 80 may be fastened into the extension ring 85 forming a loop. Then, the mooring strap clip 35 may be attached by attaching the mooring strap clip 35 to the extension strap loop or the receiver 85 as desired to form various configurations.

While the dock securing device and system has been described with detailed reference to one or more embodiments, the disclosure is to be considered as illustrative and not restrictive. Modifications and alterations will occur to those skilled in the art upon a reading and understanding of this specification. It is intended to include all such modifications and alterations in so far as they come within the scope of the claims, or the equivalence thereof.

What is claimed is:

1. A portable mooring device configured to be disposed between a boat and a mooring structure to cushion the impact between the boat and the mooring, said mooring device comprising:

a unitary fender comprising a cord-receiving aperture extending through the fender;

a fender cord; and a fender ring connected to one end of the fender cord, where the fender cord is wrapped axially around the fender through the aperture and through the fender ring, and wrapped circumferentially around the fender and through the fender ring a second time, wherein the fender cord wrapped axially around the fender forms a first loop and the fender cord wrapped circumferentially around the fender forms a second loop, the second loop being substantially transverse to the first loop.

2. The mooring device according to claim 1, wherein the fender ring is one selected from the group consisting of metal ring, plastic ring, rope loop, rope eye splice, and clip.

3. The mooring device according to claim 1, wherein the cord-receiving aperture is through the fender along an axis of the fender.

4. The mooring device according to claim 1, wherein the fender is substantially cylindrical around the aperture.

5. The mooring device according to claim 1, wherein the fender is adapted to cushion an impact force between an associated boat and an associated dock piling.

* * * * *